US007143459B2

(12) United States Patent
Petzl

(10) Patent No.: US 7,143,459 B2
(45) Date of Patent: Dec. 5, 2006

(54) ICE AXE OR HAMMER AXE WITH HOLLOW SHAFT EQUIPPED WITH A STOP

(75) Inventor: Paul Petzl, Barraux (FR)

(73) Assignee: Zedel, Crolles (FR)

( * ) Notice: Subject to any disclaimer, the term of this patent is extended or adjusted under 35 U.S.C. 154(b) by 100 days.

(21) Appl. No.: 10/965,835

(22) Filed: Oct. 18, 2004

(65) Prior Publication Data

US 2005/0144731 A1 Jul. 7, 2005

(30) Foreign Application Priority Data

Jan. 6, 2004 (FR) ..... 04 00052

(51) Int. Cl.
*B25D 1/04* (2006.01)

(52) U.S. Cl. ..... 7/145; 7/143; 81/20

(58) Field of Classification Search ..... 7/143, 7/145; 81/20

See application file for complete search history.

(56) References Cited

U.S. PATENT DOCUMENTS 4,727,609 A * 3/1988 Smith, Jr. ..... 7/145

FOREIGN PATENT DOCUMENTS

| | | |
|---|---|---|
| EP | 0 555 156 A1 | 8/1993 |
| EP | 1 388 353 A1 | 2/2004 |
| SU | 1657210 A1 | 6/1991 |

* cited by examiner

*Primary Examiner*—Joseph J. Hail, III
*Assistant Examiner*—Shantese McDonald
(74) *Attorney, Agent, or Firm*—Oliff & Berridge, PLC

(57) ABSTRACT

An ice axe or hammer axe comprises a gripping shaft having a hollow tube equipped with a stop which is mounted retractable at the end of the shaft between a first retracted position and a second working position. The stop is formed by a plug equipped with a spur salient from the shaft in the second working position to form a stop means for ease of gripping and handling the ice axe.

9 Claims, 3 Drawing Sheets

ICE AXE OR HAMMER AXE WITH HOLLOW SHAFT EQUIPPED WITH A STOP

BACKGROUND OF THE INVENTION

The invention relates to an ice axe or a hammer axe for mountaineering comprising a gripping shaft having a hollow tube equipped with a pick tool at the top end, and with a stop at the bottom end.

STATE OF THE ART

It is conventional to fix a superficial sleeve around the bottom part of the metal shaft of a mountaineer's ice axe. The document FR-A-2,709,971 describes an anatomical grip formed on the shaft opposite the head of the ice axe and fixed onto the shaft by any process, in particular by hafting, molding from a casting or sticking. The presence of this grip improves the grasp on the ice axe, but increases its weight and does not allow the shaft to be made to penetrate into the snow to form an anchor or a relay point.

OBJECT OF THE INVENTION

The object of the invention is to achieve a versatile ice axe having a light gripping shaft that can be easily handled by the mountaineer.

The ice axe according to the invention is characterized in that the stop is fitted retractable at the end of the shaft between a first retracted position and a second working position, the stop being formed by a plug equipped with a spur laterally salient from the shaft in the second working position to constitute a stop means for ease of gripping and handling of the ice axe.

According to a preferred embodiment of the invention, the quadrangular plug has opposite sides parallel two by two, and an orifice in the central part to receive a fixing screw. One of the sides of the plug bears a protuberance and is extended by the spur salient on the other adjacent side, the protuberance and the spur engaging in a notch of the shaft, respectively in the first retracted position and in the second working position of the stop.

In the first retracted position, the spur of the stop is invisible and the protuberance is housed in the notch leaving the shaft smooth. In the second working position, the spur is visible and acts as stop means at the end of the shaft to improve the grip and handling of the ice axe. In both positions, the stop blocks off the end of the shaft preventing any snow or ice from getting into the tube.

Other features can be used either alone or in combination:

- the plug of the stop is fitted retractable by disassembly and turning a quarter of a turn;
- the bottom end of the shaft comprises a beveled end so as to present an anchoring pick and an orifice for inserting the stop;
- the stop is located withdrawn from the anchoring pick inside the tube, blocking off the orifice of the shaft in both the first and second positions;
- the plug of the stop is made of plastic material and has a square shape;
- the stop is mounted on a rotary support pin between the first and second positions.

BRIEF DESCRIPTION OF THE DRAWINGS

Other advantages and features will become more clearly apparent from the following description of a particular embodiment of the invention, given as a non-restrictive example only and represented in the accompanying drawings, in which.

DESCRIPTION OF A PREFERRED EMBODIMENT

Figure 1:
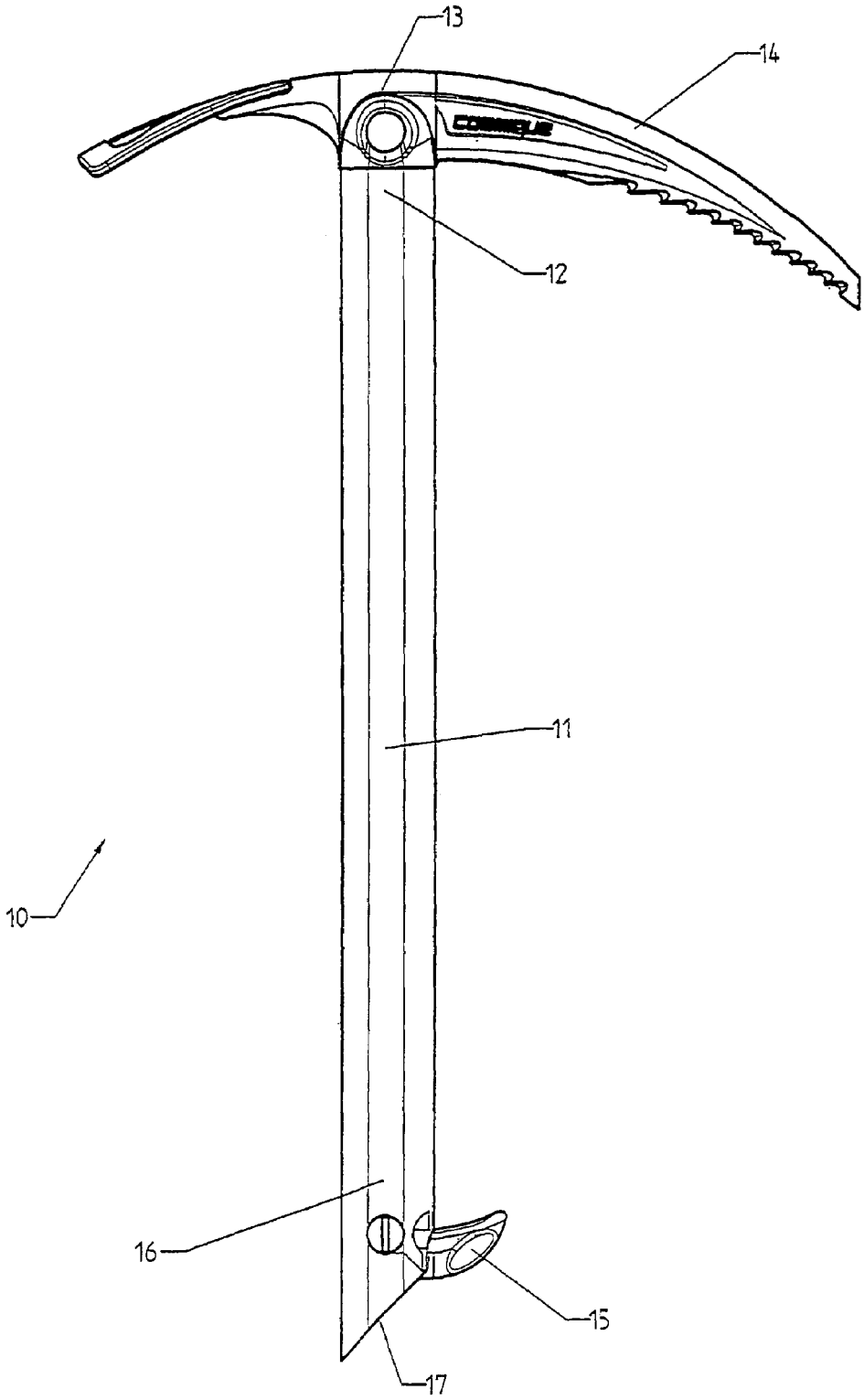
FIG. 1 is a schematic view of an ice axe equipped with a stop according to the invention.
Figure 2:
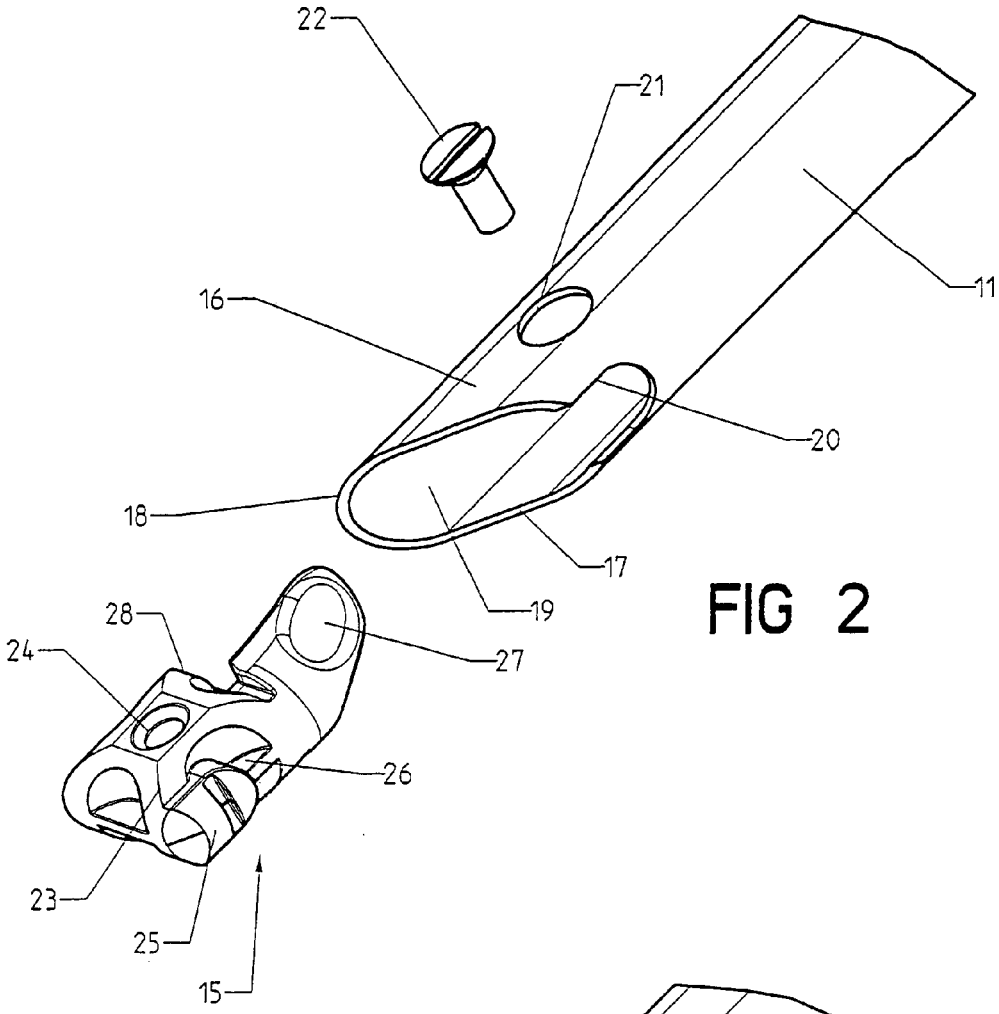
FIGS. 2 and 3 show perspective views of the end of the shaft, before and after the stop has been inserted in the first retracted position, in which the spur is invisible.
Figure 3:
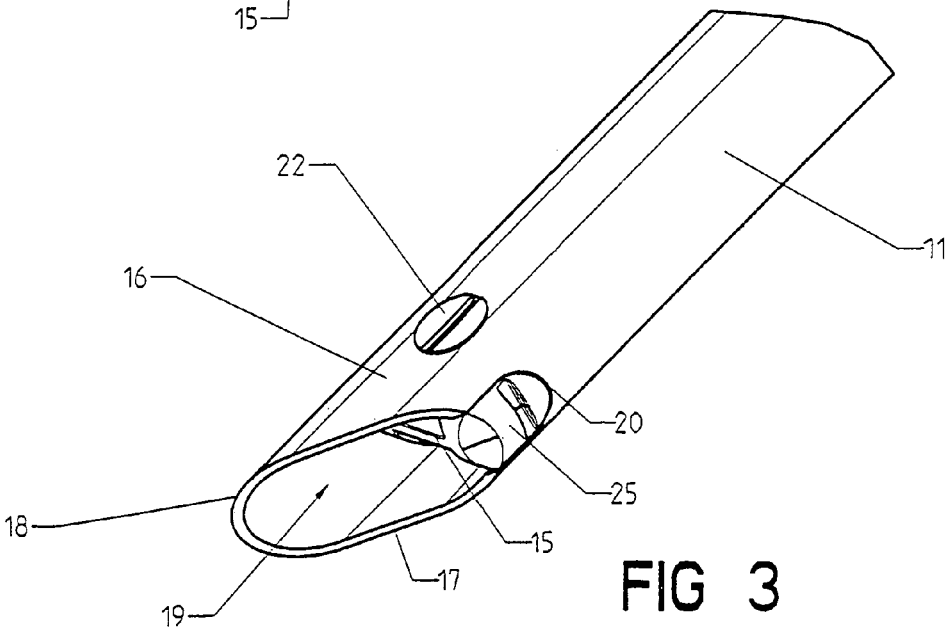

In FIG. 1, the ice axe 10 comprises a gripping shaft 11 formed by a hollow tube, receiving at the top end 12 thereof the support head 13 of the pick tool 14 and provided with a stop 15 at the bottom end 16. The tube can be made of metal, in particular aluminium alloy, or of reinforced plastic material.

With reference to FIGS. 2 to 5, the end 17 of the shaft 11 situated at the bottom end 16 is beveled so as to present an anchoring pick 18, and an orifice 19 for inserting the stop 15.

Opposite the anchoring pick 18, the orifice 19 is extended by a U-shaped notch 20 extending in the longitudinal direction along a generating line of the lateral surface of the tube 11. The tube 22 in addition comprises a circular hole 21 angularly offset with respect to the notch 20, and allowing a fixing screw 22 of the stop 15 to pass transversely therethrough.

The stop 15 is inserted longitudinally in the orifice 19 so as to be located withdrawn from the anchoring pick 18, and to block off the end 17 of the tube preventing snow or ice from getting into the shaft 11. The stop 15 is formed by a quadrangular plug 23 having a hole 24 in the central zone for screwing the screw 22 into. The plug 23 has opposite sides parallel two by two and separated from one another by a distance corresponding, with an allowance for clearance, to the size of the orifice 19 of the shaft 11. The plug 23 preferably has a square shape and is made of molded plastic material.

One of the sides 26 of the plug 23 has a protuberance 25 having a complementary shape to that of the notch 20 of the shaft 11. The same side 26 is extended by a spur 27 salient from the other adjacent side 28 perpendicular to the side 26.

Figure 4:
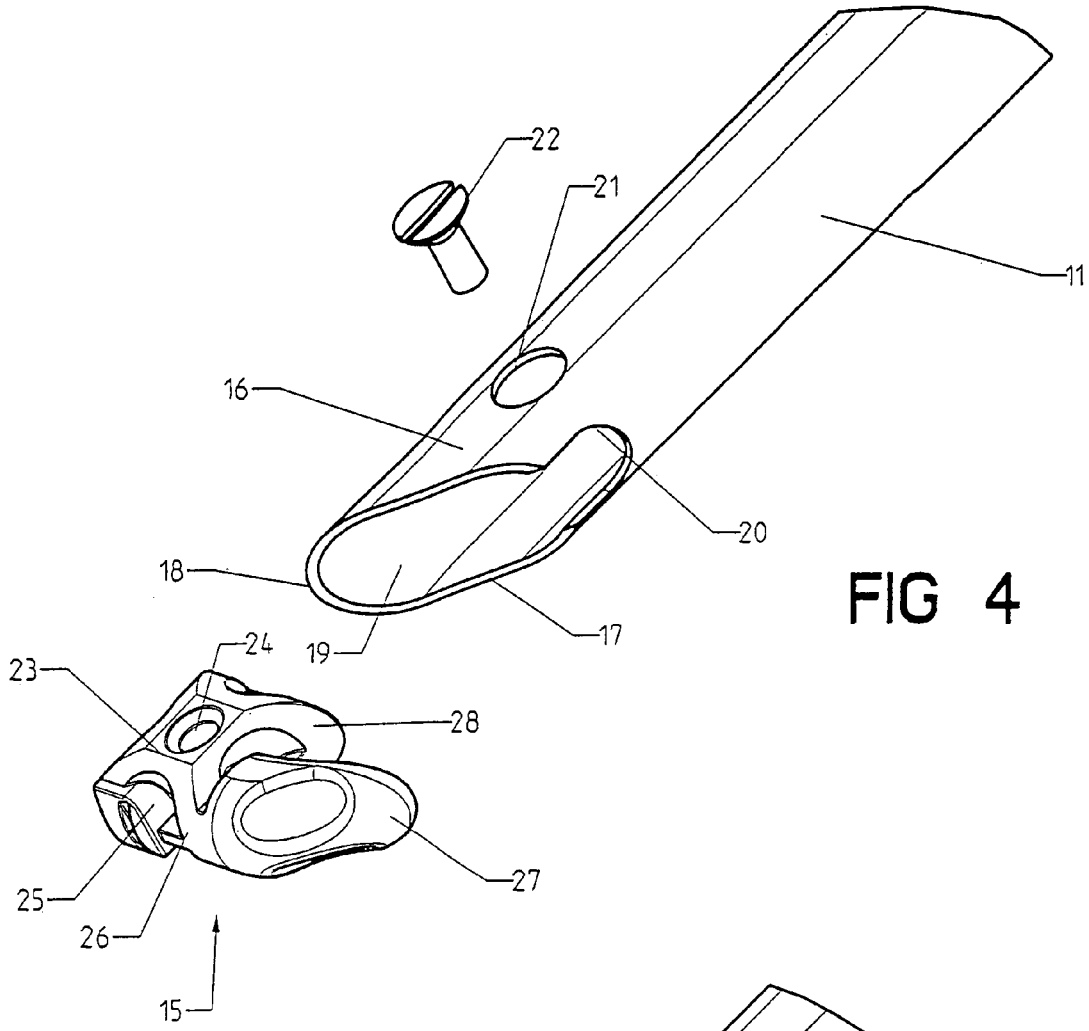
FIGS. 4 and 5 show identical views to FIGS. 2 and 3, before and after the stop has been inserted in the second working position, in which the spur is operational.
Figure 5:
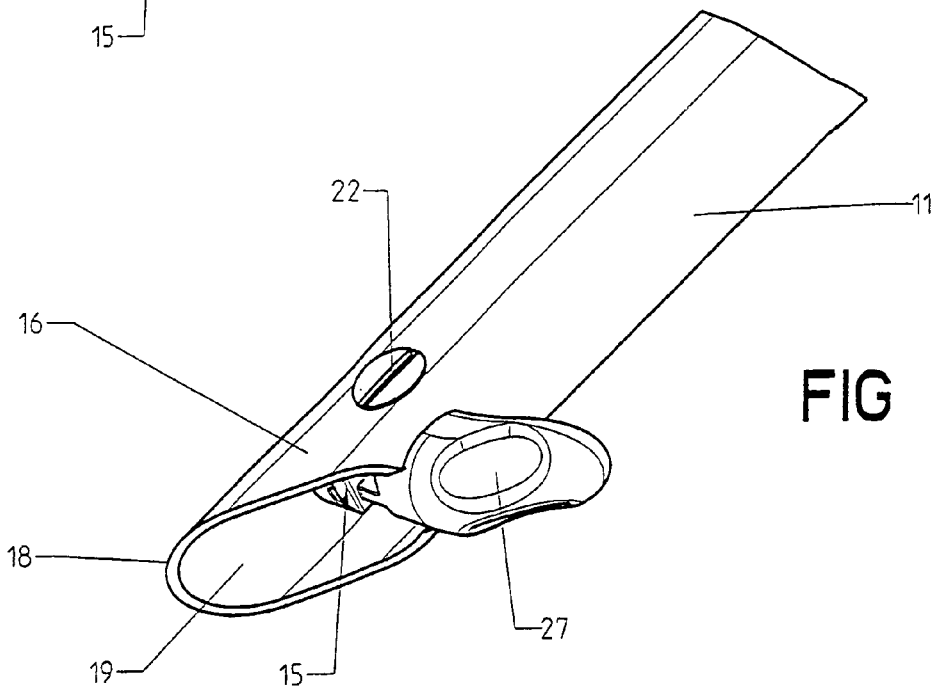

The stop 15 is fitted in retractable manner in the orifice 19 of the tube so as to occupy after insertion two distinct stable positions comprising a first retracted position wherein the spur 27 is fitted axially in the shaft 11 (FIGS. 2 and 3), and a second working position wherein the spur 27 is salient through the notch 20 in a direction perpendicular to the axis of the shaft 11 (FIGS. 4 and 5).

In both the positions, the stop 15 blocks off the end 17 of the shaft 11 preventing any snow or ice from getting into the tube. In the first retracted position (FIG. 3), the spur 27 is invisible and the protuberance 25 is housed in the notch 20 leaving the shaft 11 smooth. In the second working position (FIG. 5), the spur 27 is visible and acts as stop means at the end of the shaft to improve the grip and holding of the ice axe 10.

To change the position of the stop 15, after the screw 22 has been unscrewed, the plug 23 then simply has to be extracted and rotated through a quarter turn. This modification requires the plug 23 to be removed and refitted and the screw 22 to be unscrewed and retightened.

Changing the position of the stop 15 could naturally be achieved by equivalent means, in particular by fitting the plug 23 directly on a rotary supporting pin. The stop 15 is then retractable by rotation between the two positions.

The invention claimed is:

1. An ice axe or hammer axe for mountaineering, comprising:

a gripping shaft including a hollow tube having top and bottom ends;

a pick tool at the top end of the hollow tube; and a stop at the bottom end of the hollow tube, the stop being movable between a first retracted position in which the stop is disposed within the hollow tube, and a second working position in which the stop extends from the hollow tube, the stop including a plug and a spur laterally salient from the hollow tube in the second working position to facilitate gripping and handling of the ice axe.

2. The ice axe or hammer axe for mountaineering according to claim 1, wherein the plug of the stop includes means for moving between the first retractable position and the second working position by disassembling the stop from the hollow tube, and turning the stop a quarter of a turn, and reassembling the stop with the hollow tube.

3. The ice axe or hammer axe for mountaineering according to claim 2, wherein the plug has a quadrangular shape and has opposite sides parallel two by two, and the means for moving includes a fixing screw and an orifice in a central part of the plug to receive the fixing screw.

4. The ice axe or hammer axe for mountaineering according to claim 1, wherein one of the sides of the plug has a protuberance and is extended by said spur salient on the other adjacent side;

the protuberance and spur engaging in a notch of the shaft, respectively in the first retracted position and in the second working position of the stop.

5. The ice axe or hammer axe for mountaineering according to claim 1, wherein the bottom end of the hollow tube comprises a beveled end so as to present an anchoring pick and an orifice for inserting the stop.

6. The ice axe or hammer axe for mountaineering according to claim 5, wherein the stop is located withdrawn from the anchoring pick inside the tube, blocking off the orifice of the shaft in both the first retracted position and the second working position.

7. The ice axe or hammer axe for mountaineering according to claim 1, wherein the plug of the stop has a square shape.

8. The ice axe or hammer axe for mountaineering according to claim 1, wherein the plug is made of plastic material.

9. The ice axe or hammer axe for mountaineering according to claim 1, wherein the stop is mounted on a rotary support pin between the first and second positions.

* * * * *